US006074188A

United States Patent [19]

White

[11] Patent Number: 6,074,188

[45] Date of Patent: Jun. 13, 2000

[54] MULTI-PLATE HYDRAULIC MOTOR VALVE

[75] Inventor: Hollis Newcomb White, Hopkinsville, Ky.

[73] Assignee: White Hydraulics, Inc., Hopkinsville, Ky.

[21] Appl. No.: 09/062,318

[22] Filed: Apr. 20, 1998

[51] Int. Cl.[7] ..... F01C 1/10; F03C 2/08

[52] U.S. Cl. ..... 418/61.3

[58] Field of Search ..... 418/61.3

[56] References Cited

U.S. PATENT DOCUMENTS

| | | | |
|---|---|---|---|
| 3,572,983 | 3/1971 | McDermott | 418/61.3 |
| 3,826,596 | 7/1974 | Hansen et al. | 418/61.3 |
| 4,139,335 | 2/1979 | Wusthof et al. | 418/61.3 |
| 4,449,898 | 5/1984 | Lambeck | 418/61.3 |
| 4,533,302 | 8/1985 | Begley | 418/61.3 |
| 5,137,438 | 8/1992 | Miller | 418/61.3 |

*Primary Examiner*—John J. Vrablik
*Attorney, Agent, or Firm*—Lightbody & Lucas

[57] ABSTRACT

A hydraulic pressure device valve having an outer circumferential support to a surrounding housing journal is constructed of a series of flat plates brazed together to form a unitary member containing substantially all of the valving passages of the entire device.

25 Claims, 9 Drawing Sheets

MULTI-PLATE HYDRAULIC MOTOR VALVE

BACKGROUND OF THE INVENTION

Hydraulic pressure devices are efficient at producing high torque from relatively compact units. Their ability to provide low speed and high torque make them adaptable for numerous applications. U.S. Pat. Nos. 4,285,643, 4,357,133, 4,697,997 and U.S. Pat. No. 5,173,043 are examples of hydraulic motors.

Low speed high torque gerotor motors are well represented in agriculture and commercial usages. Examples include scissorlifts, wenches, grain elevators and other applications requiring well controlled remote power. Examples include the U.S. Pat. Nos. 3,572,983, 4,390,329 and 4,480,972. These devices use a powder metal rotating valve in order to connect the expanding and contracting gerotor cells to the pressure and return feeds. One perennial problem with these motors is that they are prone to stall due to the separation of the valve from either the manifold or the balancing ring that biases the rotary valve in contact with the manifold. Over the years, companies such as Eaton have struggled to develop a commercial device which does not present this particular problem. Efforts are continuing within the industry to accomplish this result.

In addition to the above, prior art rotary valve motors have contained powder metal valves which necessitated complicated dies for the manufacturer thereof. In addition, there are inherent manufacturing inaccuracies to this construction, particularly in the main valve drive spline interconnection, which inaccuracies cause timing errors in addition to other problems. In use, the wear between the valve and the balancing ring, cause leakage to occur bypassing the valve, thus significantly reducing the volumetric efficiency of the hydraulic motor.

The valve in the present invention solves these particular problems in an efficient compact easy to manufacture unit.

These prior art units, however, require extensive machining of the housing and include many parts.

The present invention eliminates these problems.

OBJECTS AND SUMMARY OF THE INVENTION

It is the object of the present invention to provide for a high speed high flow hydraulic motor having a rotational speed valve;

It is an object of this invention to improve the service life of hydraulic motors;

It is another object of the present invention to increase the volumetric efficiency of hydraulic motors;

It is a further object of the invention to reduce the parasitic bypassing of fluid about the valve;

It is another object of the present invention to eliminate the need for a separate case drain for the hydraulic motor by incorporating same into the main valve;

It is an object of this invention to reduce the complexity of gerotor motor housings;

It is still another object of the present invention to reduce the cost of and manufacturing time for hydraulic motors;

It is yet another object of the present invention to increase the adaptability of hydraulic motors;

Other objects and a more complete understanding of the invention may be had by referring to the drawings in which:

DETAILED DESCRIPTION OF THE INVENTION

Figure 1:
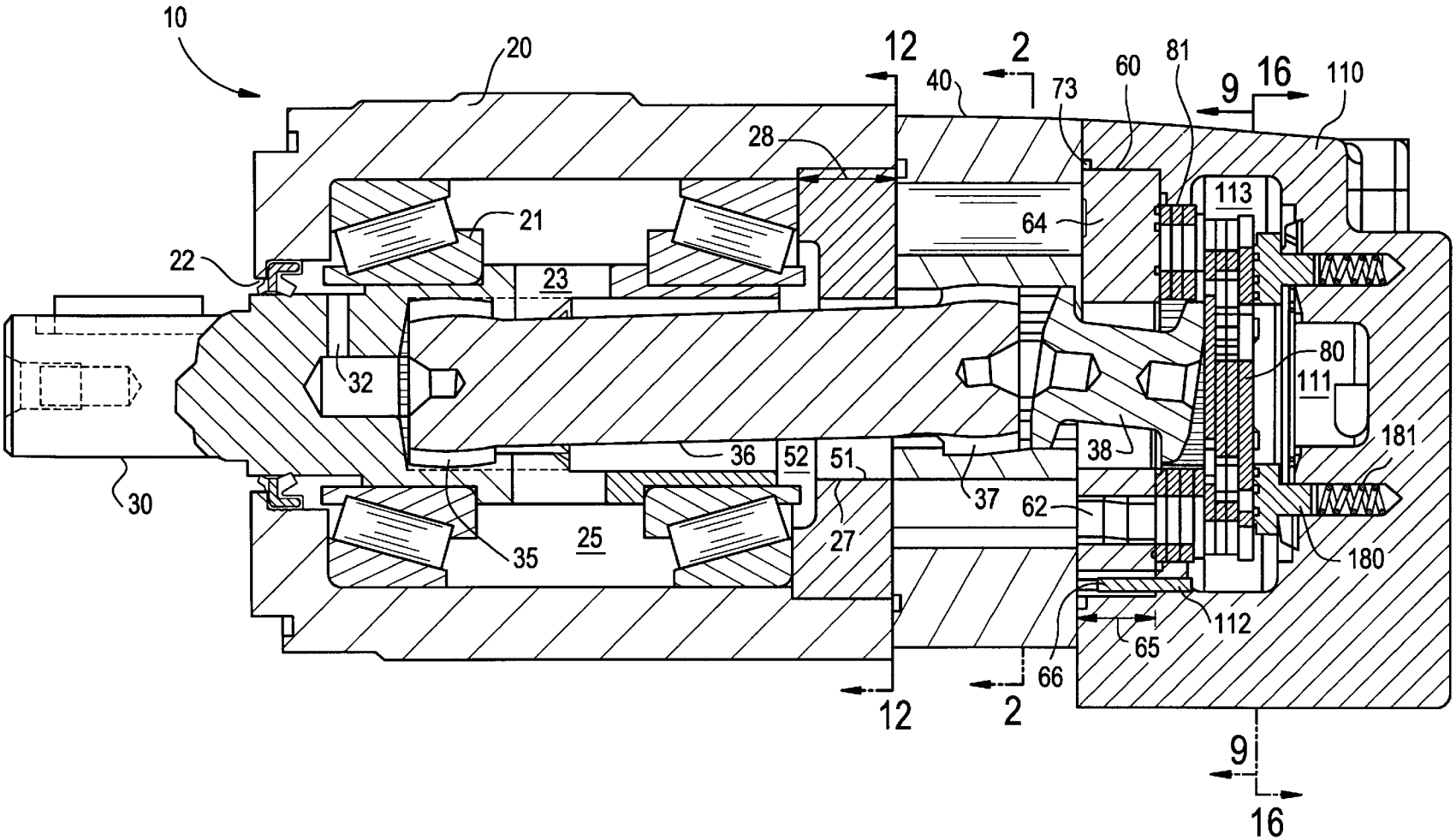
FIG. 1 is a longitudinal cross-sectional view of a hydraulic pressure device incorporating the invention of the application.

This invention relates to an improved pressure device having a multi-plate valve (FIGS. 3–11). The invention will be described in its preferred embodiment of a low speed high flow gerotor pressure device having a rotating valve separate from the gerotor structure. As understood this device will operate as a motor or pump depending on the nature of its fluidic and mechanical connections. It is designed for up to 35 gallons per minute at 4000 PSI.

The gerotor pressure device 10 includes a bearing housing 20, a drive shaft 30, a gerotor structure 40, a manifold 60, a valving section 80 and a port plate 110.

The bearing housing 20 serves to physically support and locate the drive shaft 30 as well as typically mounting the gerotor pressure device 10 to its intended use (such as a cement mixer, mowing deck, winch or other application).

The particular bearing housing of FIG. 1 includes a central cavity 25 having two roller bearings 21 rotatively supporting the drive shaft therein. A shaft seal 22 is incorporated between the bearing housing and the drive shaft in order to contain the operative hydraulic fluid within the bearing housing 20. Due to the later described integral drain for the cavity 25 within the bearing housing 20 this shaft seal 22 can be a relatively low pressure seal. The reason for this is that the case drain invention of this application reduces the pressure of the fluid within the cavity 25 from full operational pressure, typically 2,000–4,000 PSI, down to a more manageable number, typically 100–200 PSI. The use of tapered roller bearings 21 in the pressure device encourages the flow of fluid within the cavity 25 due to the fact that the bearings 21 inherently will move fluid from their small diameter section to their large diameter section. This facilitates in the lubrication and cooling of these critical components. Two large diameter holes 23, some ⅝" in diameter, between the bearings 21 allow fluid to pass to the inside of the drive shaft 30 near to the drive connection to the later described wobblestick. In addition to the above, a series of radial holes 32 in the drive shaft further facilitates the movement of fluid within the cavity 25 across the bearings 21 (see U.S. Pat. No. 4,285,653 for a further explanation).

Figure 12:
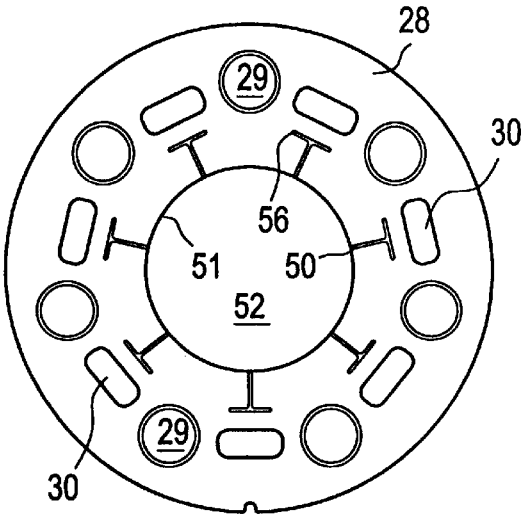
FIG. 12 is a face view of the wear plate of the embodiment of FIG. 1 taken generally from line 12—12 in that figure.

A wear plate 27 completes the bearing housing 20 (FIG. 12). This wear plate is a separate part from the bearing housing 20. As such, it can be made of different materials than the housing proper. Further, the wear plate 27 has an axial length slightly greater than the length 28 of the cavity within which it is inserted (0.003" greater in the embodiment disclosed). This distance is selected in such that the stator 41 of the later described gerotor structure 40 is in contact with the bearing housing 20 outside of the wear plate upon the application of torque to the longitudinal assembly bolts holding the device 10 together. This allows the wear plate 27 to be axially clamped between the later described gerotor structure 40 and the remainder of the bearing housing 20, thus serving to reduce the leakage from the pressure cells of the gerotor structure. This improves the efficiency of the gerotor motor. A single seal can be utilized at this location to seal the stator 41 to the bearing housing 20, thus simplifying the manufacture of a three part assembly. The wear plate 27 in addition serves to lock the bearings 21 in place in respect to the bearing housing 20.

In the particular embodiment disclosed, the bearing housing 20 is made of machine cast metal while the wear plate 27 is a powder metal part. The inherent porosity of the wear plate allows oil impregnation so as to reduce friction and increase the service life of the unit.

The drive shaft 30 is rotatively supported within the bearing housing 20 by the bearings 21. This drive shaft serves to interconnect the later described gerotor structure 40 to the outside of the gerotor pressure device 10. This allows rotary power to be generated (if the device is used as a motor) or fluidic power to be produced (if the device is used as a pump). As previously described the radial holes 23 and the radial hole 32 facilitate the movement of fluid throughout the cavity 25 thus to further facilitate the lubrication and cooling of the components contained therein.

The drive shaft 30 includes a central axially located hollow which has internal teeth 35 cut therein. The hollow provides room for the wobblestick 36 while the internal teeth 35 drivingly interconnect the drive shaft 30 with such wobblestick 36. Additional teeth 37 on the other end of the wobblestick drivingly interconnect the wobblestick 36 to the rotor 45 of the later described gerotor structure, thus completing the power drive connection for the device. A central hole drilled through the longitudinal axis of the wobblestick 36 is a possible addition to further facilitate fluid communication through the device.

The gerotor structure 40 is the main power generation apparatus for the pressure device 10.

Figure 2:
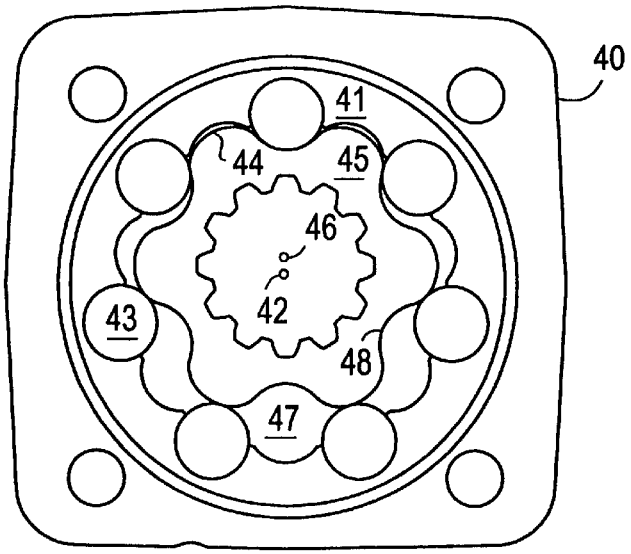
FIG. 2 is a lateral cross-sectional view through the hydraulic pressure generating gerotor structure of FIG. 1 taken substantially along the lines 2—2 in such figure.

The particular gerotor structure 40 disclosed includes a stator 41 and a rotor 45 which together define gerotor cells 47 (FIG. 2). As these cells 47 are subjected to varying pressure differential by the later described valve, the power of the pressure device 10 is generated. This occurs because the axis of rotation 46 of the rotor is displaced from the central axis 42 of the stator (the wobblestick 36 accommodates this displacement).

A case drain is designed to remove fluid from the central cavity 25 of the device. This serves to lower the pressure in such cavity (thus lowering the pressure requirements for seals and increasing tolerances) as well as removing fluid (thus assisting in lubrication and cooling of the components therein). The case drain is utilizable with any system that has some sort of way of introducing fluid into the cavity 25, with such fluid having a relatively higher pressure than the outlet side of the later described case drain mechanism. This would include devices that, while having no special passage, naturally have leakage from high pressure areas (for example due to inherent tolerances as in U.S. Pat. No. 4,362,479), devices with dedicated bleed passages (such as U.S. Pat. No. 3,862,814, U.S. Pat. No. 4,390,329 or in U.S. Pat. No. 4,533,302) or otherwise.

In the particular embodiment herein disclosed dedicated leakage passages are utilized along at least one flat surface of the orbiting rotor 45 and/or an adjoining part (such as the wear plate 27) so as to provide a connection between at least one relatively pressurized gerotor cell and the central area of the device (FIG. 12). Relatively pressurized means that the fluid pressure is sufficiently greater than that of the central area of the device that fluid will flow from the cell thereinto. This leakage path can be located on either or both of the adjoining surfaces. As the rotor 45 moves, due to the orbiting motion of the rotor about the central axis 42 of the stator, the inner valleys 48 between the lobes of the rotor define an inner limit circle 49 on the adjoining part (see FIG. 15—Note that this inner limit circle 49 in the main FIGS. 1–18 of the preferred embodiment is shown substantially equal to the diameter of the central opening 51 of the wear plate 27. This is best seen in FIG. 1. The reason for this is that the actual difference between the two in the embodiment disclosed is only 0.018" (1.298" vs. 1.280"). In other devices the two might be more markedly different. See FIG. 15 for a more obvious distinction). This inner circle 49 defines the innermost extension swept by the valleys 48 between the rotor lobes (and thus the gerotor cells 47). In the present application, there are fluid passages 50 which extend from at least this inner circle 49 to the central area 52 within the pressure device 10. This allows an amount of fluid to be parasitically drawn off of the relatively higher pressure cells 47 to pass into the central area 52. This serves simultaneously to lubricate the critical moving components of the pressure device 10 in addition to providing a cooling function therefor.

Preferably there is a leakage path from at least one relatively higher pressure gerotor cell 47 (further preferably a plurality in sequence) to an opening no larger than this inner circle 49. While any higher pressure cell could be selected, it is preferred that a cell 47 located adjacent to a dead cell be utilized (a dead cell is a cell connected to neither port, a cell that if previously connected to higher pressure would retain such until connected to lower pressure). This provides a more predictable fluid flow than the dead cell without significant loss in volumetric efficiency.

Figure 15:
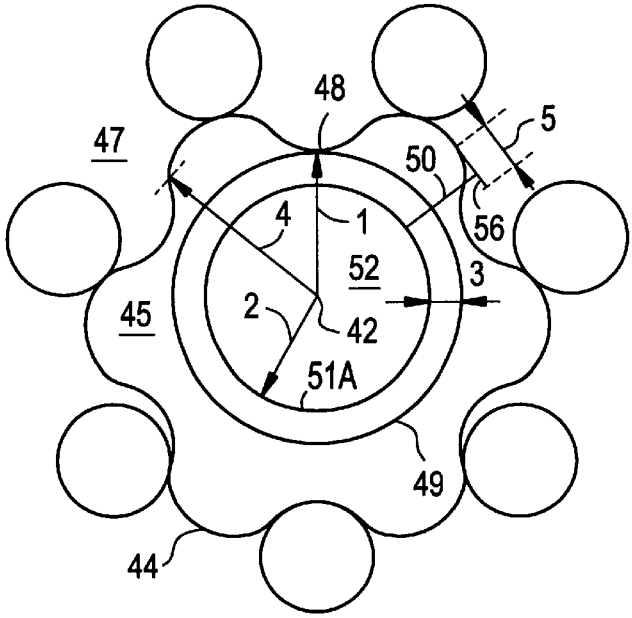
FIG. 15 is a modified enlargement of FIG. 13 highlighting the preferred parameters of the leakage passages disclosed therein.

If the controlled leakage path is located in a stationary part (such as the wear plate), the path must extend outwards to at least the dead cell with the rotor located top dead center (the top center cell shown uppermost in FIG. 15). Ideally the outer extension of this leakage path extends for a distance less than that swept by the outer tips of the rotor lobes 44 so as to provide a seal for most of the high pressure in the device. The reason for this is to reduce the loss of volumetric efficiency that would occur if all cells were fluidically connected to the central area of the device (and also to each other via other leakage paths), although under certain circumstances such a connection may be desirable (for example small leakage paths and/or need for higher fluid flow).

Figure 13:
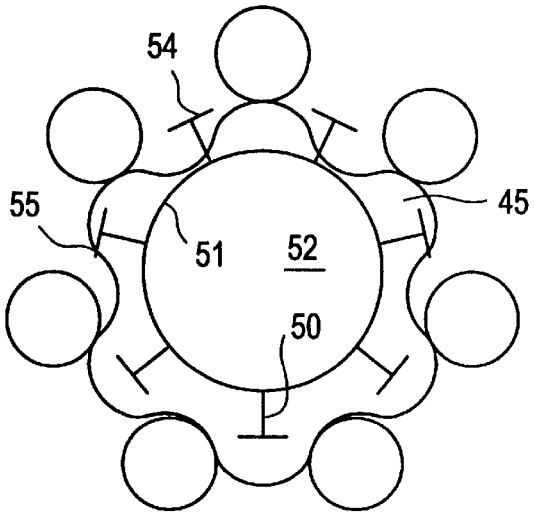
FIG. 13 is a representational view of the gerotor structure of FIG. 2 super imposed on the wear plate of FIG. 12 with a top dead center rotor positioning.

It is preferred that the leakage path also extend into an adjacent cell so as to insure a continual source of relatively higher pressure lubrication fluid (the cell at 10:30 in the bi-directional pressure device of FIGS. 1 and 15 assuming it is the next pressurized—in a known uni-directional pressure device only one would be needed). It is further preferred that the path extend such that with the rotor located bottom dead center (as shown in FIG. 13) adjacent paths extend into the cell in transition 54 (at 11:00 in FIG. 13), with the cross-over to a further cell 55 just starting to leak (at 9:30 in FIG. 13) (again assuming next pressurized). These additional connections, though not mandatory, facilitate the lubrication function of the device. Note that the inward extension of the leakage paths in a stationary part is not critical as long as it is sufficient to extend into the central cavity of the pressure device at the time that the leakage path is active. Additional inward extensions would not compromise the operation of the device.

In this preferred embodiment only 0.2 to 0.5 gallon per minute are being utilized. The number of cells having leakage paths are thus kept to a minimum to provide a continuous input flow. This continuous flow provides a constant input lubrication function without a significant parasitical volumetric efficiency loss.

The parameters behind this leakage path are set forth in example form in FIG. 15. This figure is a top dead center orientation of the structure of FIG. 13 with the diameter 51A of the central area 52 reduced for clarity of explanation. The first parameter is the radius 1 of the inner limit circle 49 defined by the valleys 48 between rotor lobes 44. This radius 1 defines the inward extension of the gerotor cells 47 towards the central longitudinal axis 42 of the gerotor pressure device 10. The second parameter is the radius 2 of the central opening 51 defining the outer extent of the central area 52. This radius 2 defines the location to which the leakage passage 50 must extend to provide lubrication for such area 52. This radius 2 will vary considerably depending on the device. The leakage passage 50 itself extends from 49 to 51 (51A in FIG. 15) across distance 3 (i.e., radius 1 minus radius 2). Further extension outward from the inner limit circle 49 connects that leakage passage to its respective gerotor cell sooner and for a longer time (subject to a continual leakage if extended beyond the outer position of the rotor lobes 44). An example of this would be the extension of the passage 50 along vector 4. With this extension the respective gerotor cell would be interconnected to the central area 52 before becoming a dead pocket, and would be interconnected longer than it would have been had the extension along this vector 4 stopped at the inner limit circle 49. It is preferred to increase the lateral extension 56 (or to use multiple passages per cell) in combination with a moderate further outward extension so as to optimize lubrication without unduly compromising volumetric efficiency. (A similar factor could be adjusted by not having a passage for every gerotor cell.)

Figure 14:
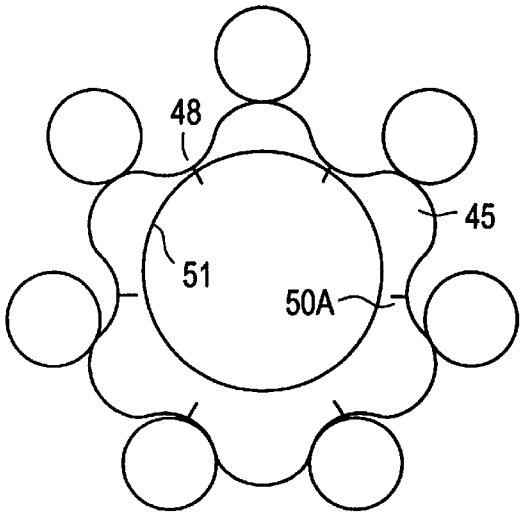
FIG. 14 is a representational view like FIG. 12 of the gerotor structure of FIG. 2 with with lubrication fluid passages in the rotor instead of the wear plate.

The design technique is similar for the later described leakage passages in the rotor (FIG. 14). The only difference is that the passages extend inward in the rotor from the rotor valleys 48 to central opening 51 (51A) to contact same. Preferably this is accomplished in the center of the valleys 48 so as to provide symmetrical bi-directional operation.

In the preferred embodiment disclosed in FIGS. 1 and 12, these passages 50 are "T" slots cut into the wear plate 27 (see FIG. 12). With the slots so positioned, there is one slot interconnected to the dead pocket in a top dead center position rotor (FIG. 15) with a second more active slot 53 (higher pressure rotation direction assumed) leaking to the central area 52 of the pressure device. In a corresponding bottom dead center position (FIG. 13), there would be one leakage path going to the almost dead pocket and a further slot just starting to have leakage to the central area 52 (again pressure direction assumed).

Due to the fact that these cells are pressurized at full operating pressure, some 2,000–4,000 PSI, while the central area 52 of the gerotor device is at a lower pressure, perhaps 200 PSI, fluid will readily flow through the passages 50 from this gerotor cell to the central area 52, thus providing the desired lubrication and cooling fluid. The radial extension 56 at the outer end of the passages 50 allow for an increased amount of leakage over a longer period of time than would be possible with a straight laterally extending passage 50 (i.e. without the radial extension 56). This facilitates the continuity of the flow of the lubrication fluid into the central area 52 of the device.

The location of the passages 50 in the wear plate 27 is preferred to a location in the later described manifold due to its axial separation from the later described pressure release-case drain mechanism in the rotating valve of the valving section 80. Note that although the passages 50 are shown located in a non-moving part, the wear plate 27, they could also be located in the rotor 45 as long as the same conditions are met—i.e. there is a leakage path from the gerotor cells 47 into the central area 52 of the device. This would be accomplished by placing a small inwardly extending passages within the rotor 45, preferably at the base of the lobes thereof, sufficiently long enough to extend into the central hole of the wear plate 27 or later described manifold 60 thus to provide for the desired leakage.

The particular wear plate disclosed is 3" in diameter and 0.650" thick. It includes a central opening of substantially 1.280" in diameter in addition to a surrounding bearing clearance groove of substantially 2" in diameter. There are seven recesses 29 substantially 0.375" in diameter and from 0.030–0.040" deep equally spaced around the diameter on a 2.3" diameter circle aligned with the central axis of the rolls 43 of the gerotor structure 40. There are in addition, seven balancing recesses 30 some 0.40" in width and 0.25" in depth equally spaced around the wear plate on the same diameter as the recesses 29. The depth of these balancing recesses 30 is the same as the recesses 29. In addition to the above, the passages 50 extend some 0.25" from the central opening in the wear plate some 0.020" in width and 0.020–0.025" in depth. The "T" section 56 at the top of these passages 50 extend for 0.260" in radial width and 0.020" in axial width. Again, the depth of these passages 50 is from 0.020–0.025" in depth. In differing devices with differing parameters, these dimensions would change.

Figure 18:
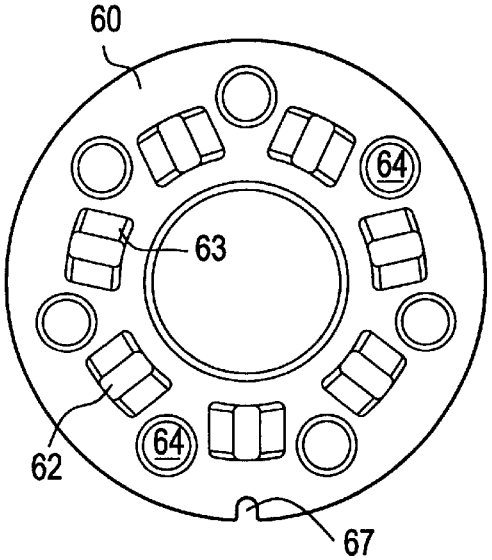
FIG. 18 is a surface view of the manifold of FIG. 1.
Figure 3:
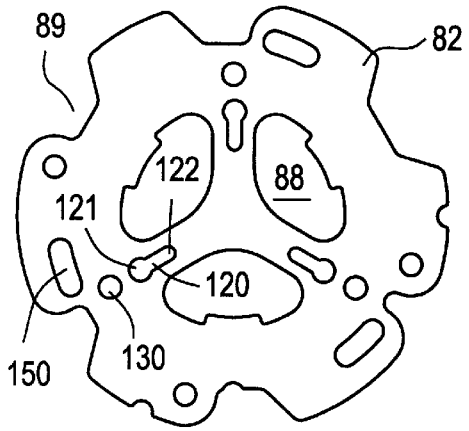
FIGS. 3–7 are selective cross-sectional views of the plates in the rotating valve of the gerotor device of FIG. 1 of these figures.
Figure 4:
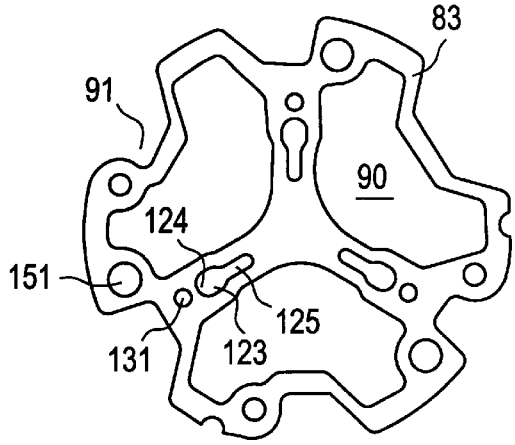
Figure 5:
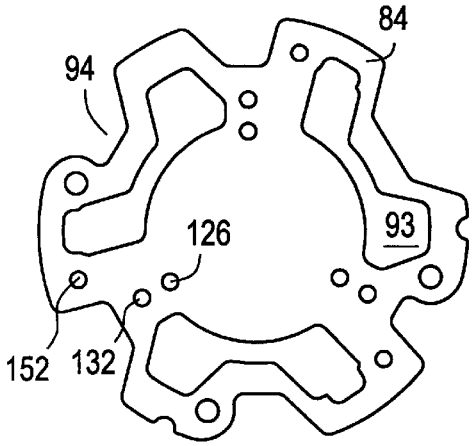
Figure 6:
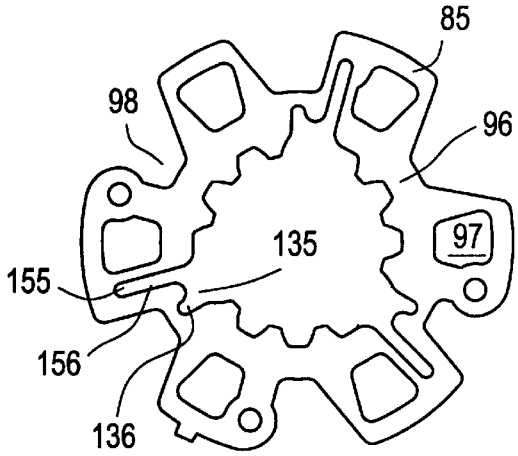
Figure 7:
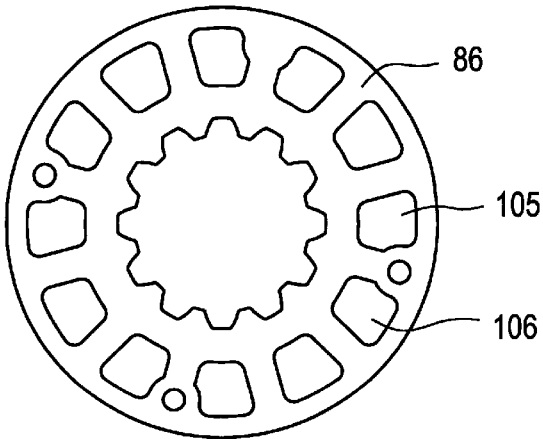
Figure 8:
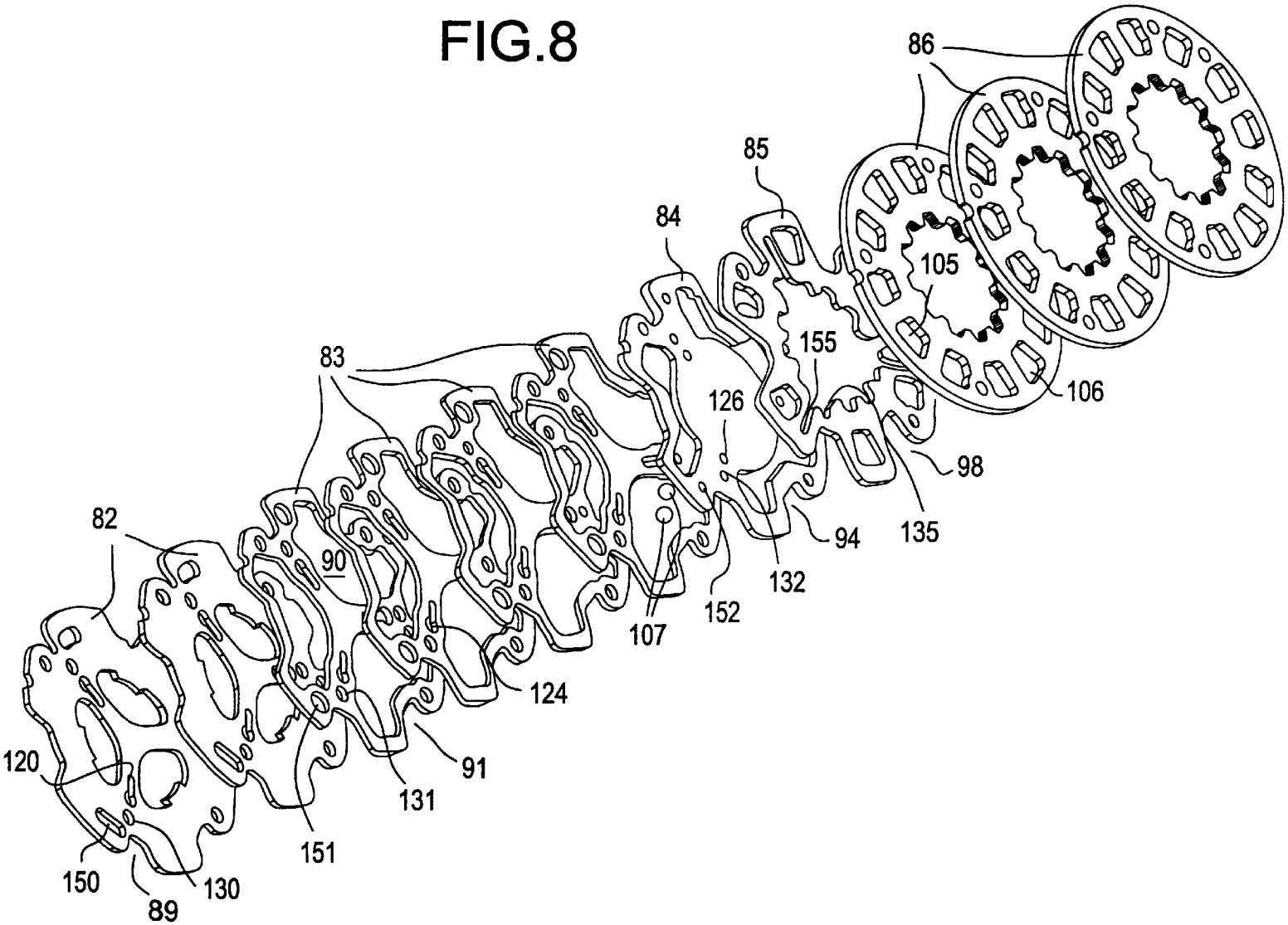
FIG. 8 is a perspective drawing showing the plates of the value separated in proper order and number.

The manifold 60 in the port plate 110 serves to fluidically interconnect the later described valve to the gerotor cells 47 of the gerotor structure 40, thus to generate the power for the pressure device 10 (FIG. 18).

In the particular embodiment disclosed, since the valve is a rotating valve, phase compensation is not necessary. As such, the valving passages 62 can extend straight through the manifold 60. The particular manifold disclosed includes recesses 64 directly centered on the rolls 43 of the stator 41. These serve to reduce the axial pressure on such rolls 43 (corresponding recesses 29 in the wear plate 27 provide a similar function at the other end of the rolls 43). In addition, the manifold openings are expanded at their interconnection with the gerotor cells 47 relative to the openings of the through valving passages 62 on the other side of such manifold. (Balancing recesses 30 in the wear plate 27 serve to equalize the pressure on alternate sides of the rotor 45). As with the wear plate 27, the axial length of the manifold 60 is greater than the axial length 65 of the cavity in the port plate within which it is contained, again some 0.003" in the preferred embodiment disclosed. This serves to clamp the gerotor structure 40 with substantially equal pressure on both sides thereof, thus to reduce leakage and improve the overall efficiency of the pressure device the same parameters as the wear plate 27 apply to selection of distances. Similarly with the wear plate, the manifold 60 is of powder metal construction for reasons as previously explained. A pin 66 in combination with a slot 67 in the manifold and a hole 112 in the port plate 110 retains the manifold in rotary alignment with the gerotor structure 40 and valve 80 during assembly and use.

Figure 19:
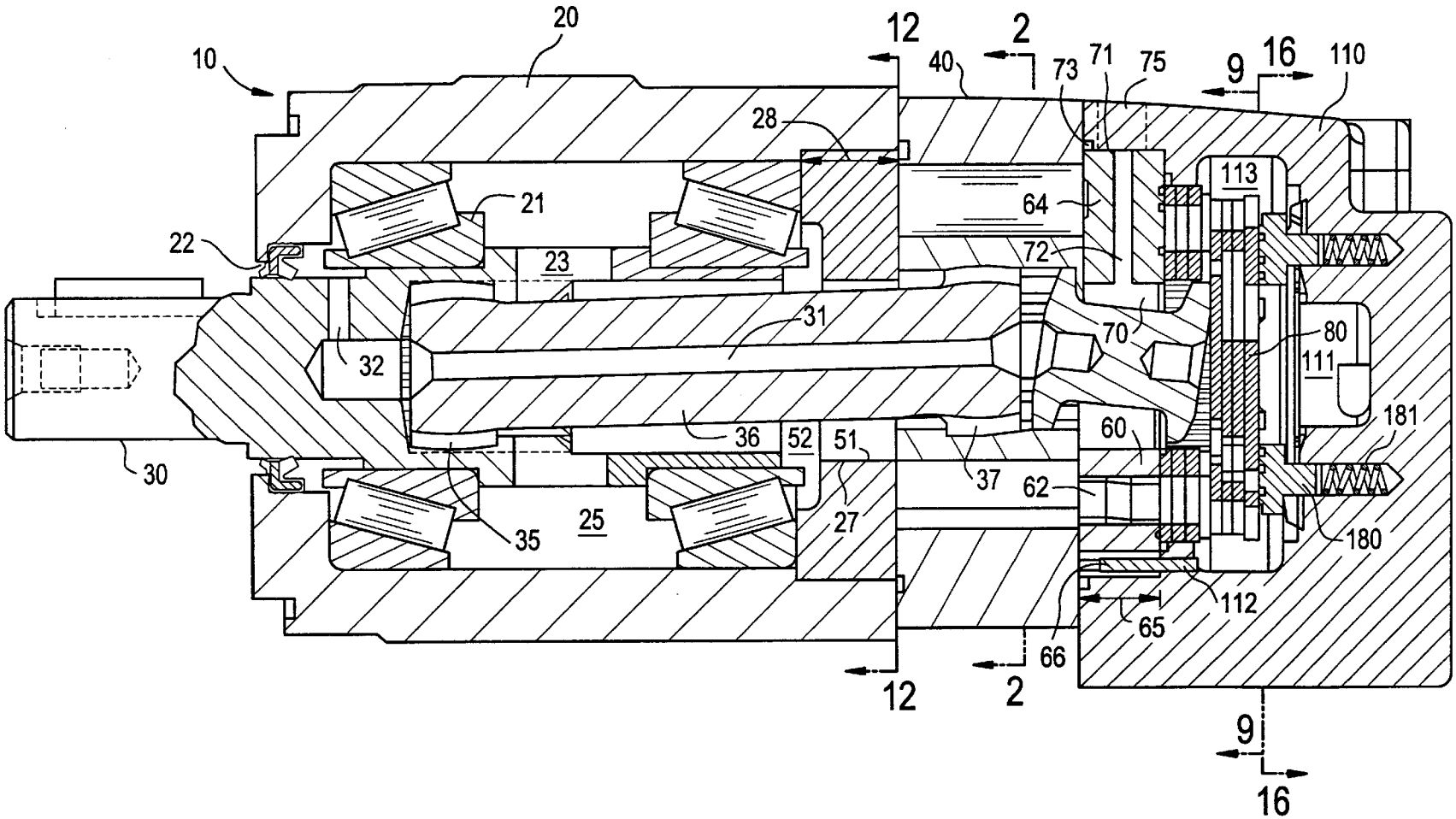
FIG. 19 is a cross-sectional view like FIG. 1 of an alternate embodiment.

The manifold 60 in the port plate 110 also can serve as a location for an additional/alternate dedicated leakage path (FIG. 19). Although not preferred as a location for a leakage path (due to its proximity to the case drain in the valve) it was discovered that the area 71 immediately surrounding the manifold 60 was subjected to high pressure when the outer port 113 pressurized, primarily via leakage past the outer surface of the valve 80. This provided a relatively convenient source or lubrication fluid for a leakage path. In addition a leakage path at this location would lower the relative pressure at this location (and on the seal 73). The inclusion of a hole 72, or series of holes 72, from this area 71 to the center 70 of the manifold 60 provides this. (If the outer port 113 is connected to low pressure, since the later described case drain in the valve would be also, the hole 72 is relatively pressure balanced between its inner and outer ends. It would thus not compromise the volumetric efficiency of the device under this alternate connection.) This hole 72 may be included in addition to or instead of the previously described first dedicated leakage passage.

The second fluid leakage passage 72 in the manifold 60 could also form part of a separate case drain for the hydraulic device (for use with or instead of the later set forth valve case drain). This would be attractive for applications wherein a separate drain line isolated from the valve 80 or ports 110, 113 is desired. To provide for this separate case drain a drain port 75 would be located extending from the area 71 to the outside of the device, preferably directly radially outwards so as to simplify its manufacture. The drain port 75 would be threaded or otherwise rendered into a form for an external drainline (not shown). Multiple holes 72 would be preferred on an outer circumferential groove so as to increase the connection dwell time between the port 75 and the center 70 of the manifold 60 (via holes 72). This drain port 75 would simultaneously lower the unit pressure on the area 71 (especially if port 113 is pressurized) while also providing for a case drain for the center 52 of the device 10. Towards this end if the first set of dedicated leakage paths is eliminated it is preferred that longitudinal hole 31 be included in the wobblestick 36 (FIG. 19). This hole 31 allows movement of fluid down the center of the wobblestick towards the drive connection 35, such movement assisted by the centripetal radial forces on the fluid provided by hole 32 and the previously described pumping action of the front bearing 21. The holes 23 and the back bearing 21 further encourage movement of fluid in the center of the device and across the back drive connection 37. These connections are cooled and lubricated by this fluid flow.

The valving section 80 selectively valves the gerotor structure to the pressure and return ports.

The particular valve 81 disclosed is a rotary valve of multi-plate construction including a selective compilation of five plates (FIGS. 3–11). The outer circumferential surface of rotary valve 81 is rotatively supported in the housing of port plate 110 as shown in FIG. 1.

The particular valve 81 is an eleven plate compilation of a two communication plates 82, five transfer plates 83, 84, a single radial transfer plate 85 and three valving plates 86. Due to the use of a multiplicity of plates, the cross-sectional area of each opening available for fluid passage is increased over that which would be available if only a single plate of each type was utilized. The plates themselves are brazed together so as to form an integral multi-plate valve.

The communication plate 82 contains a segmented inner area 88 which communicates directly to the inside port 111 in the port plate 110. The communication plate 82 also contains six outer areas 89 which are in communication with the outside port 113. The plate thus serves primarily to interconnect the valve 81 to the pressure and return ports of the gerotor pressure device 10. The communication plate 82, in addition, contains three sets of three holes 120, 130 and 150 (To avoid confusion and duplication, only one set of holes is numbered in the drawings).

The hole 120 serves to interconnect part of the case drain to the port 111, thus serving as one-half of the later described case drain. The hole 130 interconnects with the recessed areas on the later described balancing ring, thus to interconnect same to the central area 52 of the hydraulic device 10. The hole 150 interconnects to the port 113, thus forming the second-half of the case drain. The middle holes 130 are included to equalize fluid pressure on the later described balancing piston. It is preferred that the number of middle holes 130 differ in number than any blocking lands on the adjoining balancing ring (3 holes vs. 4 lands shown).

The particular communication plate 82 is 2.48" in diameter and 0.042" deep. The inner area 88 is formed of three segments separated by three lands 0.250" in width. These lands are large in order to provide for the three through holes 120, 130, 150 that serve as the pressure release mechanism. The outer hole 150 of this mechanism sweeps an area radially outside of the balancing ring and thus connects the outside port 113. This outer hole 150 is an arched oval some 0.200" in straight section length and 0.130" in width with 0.130" diameter ends (0.330" in total length). The central radial axis of the outer hole 150 is spaced from the center 100 of the valve 81 by 1.013" arching about such center. The middle hole 130 of this mechanism is 0.130" in diameter with a location substantially matching the center land of the later described balancing piston (0.815" radius) (3 total). The inner hole 120 of this mechanism is key slot shaped, with a head 121 some 0.130" in diameter having a center spaced 0.615" from the center 100 of the valve. A leg 122 some 0.185" in center to center length and 0.080" in width extends inward off the head 121. The center to center leg 122 off of the inner hole 120 and width of the outer hole 150 allows for a bypassing movement of the fluid past the sealing check balls contained therein. This lowers the forces on the check balls and increases the longevity of the pressure release mechanism.

In order to provide for the necessary alternating passages 105, 106 in the valving plate 86, the first 83, second 84 and third 85 transfer plates shift the fluid from the inner 88 and outer 89 areas in the communication plate 82.

The first transfer plate 83 contains a series of three first intermediate passages 90 which serve to begin to transfer fluid from the inner area 88 outwards. It also includes a series of six second outward passages 91 which communicate with the outer areas 89 in the communication plate to laterally transfer fluid. Since the outside port 113 directly surrounds the valve 81, these passages 91 also serve to interconnect to the outside port 113.

As with the communication plate 82, the particular first transfer plate 83 is 2.48" in diameter and 0.041" in depth. The three large symmetrically oriented intermediate passages 90 comprise the majority of this plate, such passages 90 extending in aggregate some 345° separated by three lands some 0.240" in width. An enlarged hole 151 some 0.180" in diameter connects to the outer hole 150. The center of this hole is spaced 1.038" from the center 100 of the valve. The middle hole 131 is reduced in diameter to 0.100" to allow more room for hole 123. Its center is spaced 0.780" from the center 100 of the valve. The hole 123 in this plate is a key-shaped slot with a substantially oval head some 0.150" in diameter having centers space 0.040" from each other. The innermost center is spaced 0.565" from the center 100 of the valve. The leg 125 is some 0.220" in center to center length having a width some 0.080" extends inward off of the head 124.

A second transfer plate 84 completes the movement of the fluid from the inner and outer areas of the communication plate 82. It accomplishes this by a series of three second intermediate passages 93 which serve to complete the radial movement of fluid from the inner area 88 of the communication plate 82. A set of third outer passages 94 interconnect with the second outward passage 91 in the transfer plate 83 to complete the lateral movement of fluid therefrom. Again, since the outside port 113 surrounds the valve, the third outer passages 94 also directly interconnects to the outside port 113.

The particular transfer plate 84 is 2.48" in diameter and 0.082" in depth. The increased depth is incorporated to provide for good sealing between the central cavity of the device and the inner port 111 as well as a bearing surface for valve end of the valve stick. Three radially spaced passages 93 extend some 115° each to complete the shifting of the fluid of the inside port. The inner radius of these passages 93 is some 0.630" with separating wall width of 0.350" and 0.485" respectively. The walls have three holes 152, 132 and 126 some 0.080" in diameter therein. The outer hole 152 is spaced 1.050" from the center 100 of the valve 81 and the inner hole 126 is spaced 0.565" from such center. These dimensions allow for the seating of the check balls 107 without interference non-withstanding the slight radial offset of these holes from their respective companions in plate 83. The center hole 132 is spaced 0.750" from the center of the valve (since there is no seating of a ball check in respect to this passage, location is not critical). The check balls 107 in the holes 151 and 131 in plates 82, 83 seal on these holes 152 and 132 respectively when subjected to an inward higher relative pressure.

The radial transfer plate 85 segments the second intermediate passages 93 so as to provide for the alternating valving passages in the valving plate 86. This is provided by cover sections 96 for the middle of such passages 93. This separates the two passages 97, 98 therein to initiate alternate placement thereof. Two passages 155, 135 extend outwards from the central opening so as to interconnect the holes 120, 130, 150 thereto (and thus the cavity 25).

The particular radial transfer plate 85 is 2.55" in diameter and 0.060" in depth. The central opening is a spline having 12 teeth on a pitch diameter of some 1.10" and a major diameter of some 1.20". The passages 97 are substantially identical to the valving passages 105 in the valving plate 86 with an inner radius of 0.800", an outer radius of 1.125", 60° on center to the next passage 105. The passages 98 have an inner radius of 0.800" and alternate with passages 97 separated therefrom by triangular lands varying from 0.080" to substantially 0.200" in width. Passage 155 is some 0.079" wide extending 1.050" from the center of the plate 85. The outer end 156 of this passage is aligned with hole 152 in plate 84. Passage 135 is 0.079" wide some 30° offset from passage 155 and extending 0.750" from the center of the plate 85. The outer end 136 of this passage is aligned with hole 132 in plate 84. Hole 126, being inward of hole 132, is also connected to this passage 135.

The valving plate 86 contains a series of alternating passages 105, 106 which terminate the inner 88 and outer 89 areas of the communication plate 82 to complete the passages necessary for the accurate placement of the valving openings in the device. In the valving plate 86 the first 105 of the alternating valving passages are thus interconnected to the inside port 111 while the second 106 of the alternating passages are connected to the outside port 113 by the previously described passages. The use of four valving plates 86 allows for a solid, reliable connection to the valve stick that rotates the valve.

The particular valving plate 86 is 2.55" in diameter and 0.082" thick. The central drive opening is a 12 tooth spline having a 1.10" pitch diameter, a 1.20° major diameter and a 1.01" minor diameter. The outer radius of the alternating passages 105, 106 is 1.125" and the inner radius 0.800". The passages are located 30° on center separated from adjoining passages by lands 0.200" wide.

In the valving plate 86 the first of the alternating valving passages 105 is interconnected to the inside port 111 while the second of the alternating passages 106 is connected to the outside port 113 by the previously described passages in the communication plate and transfer plates as previously described.

Figure 10:
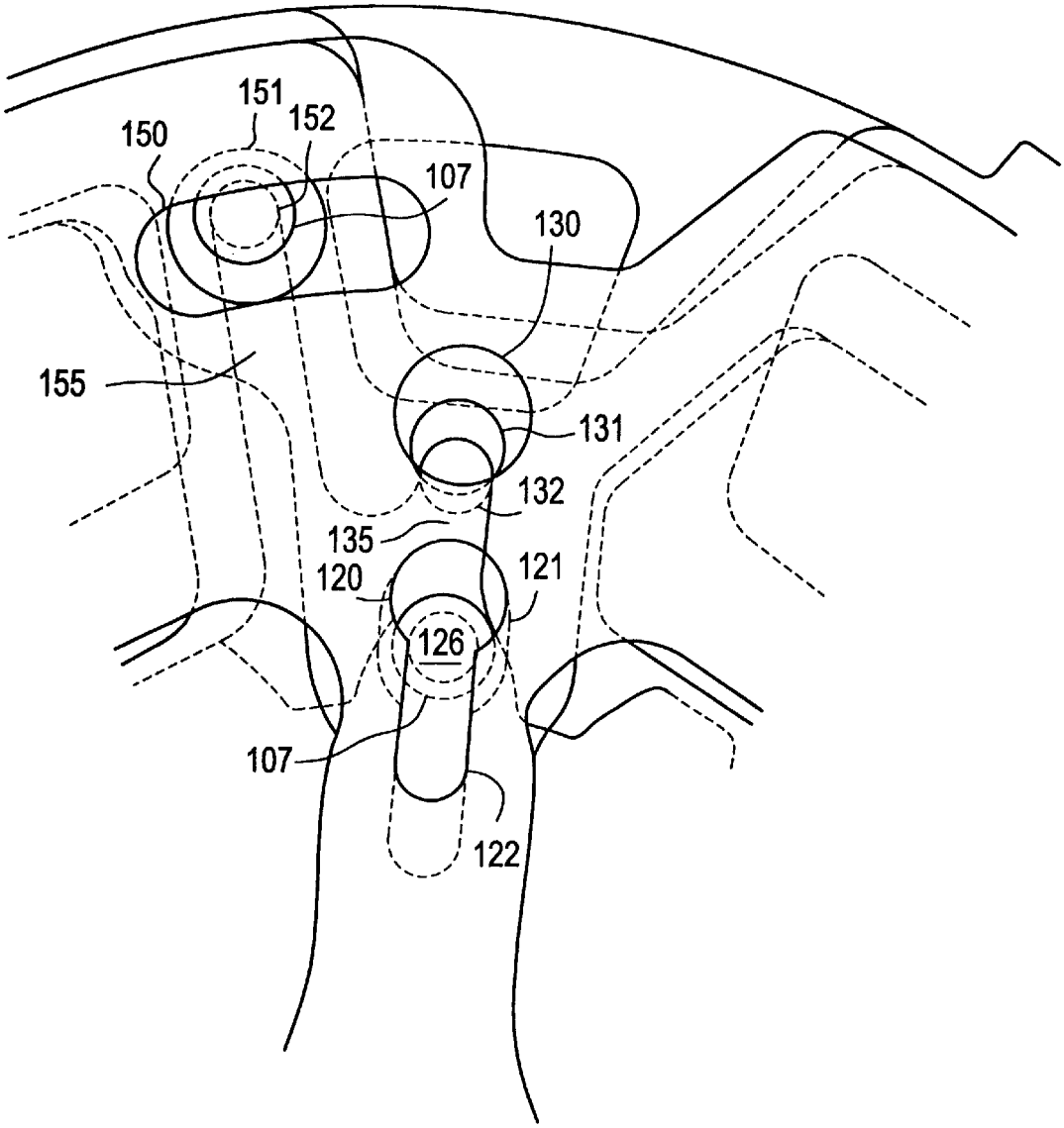
FIG. 10 is an enlarged view of an angular section of FIG. 9 highlighting the cooperation of the drain passages.
Figure 11:
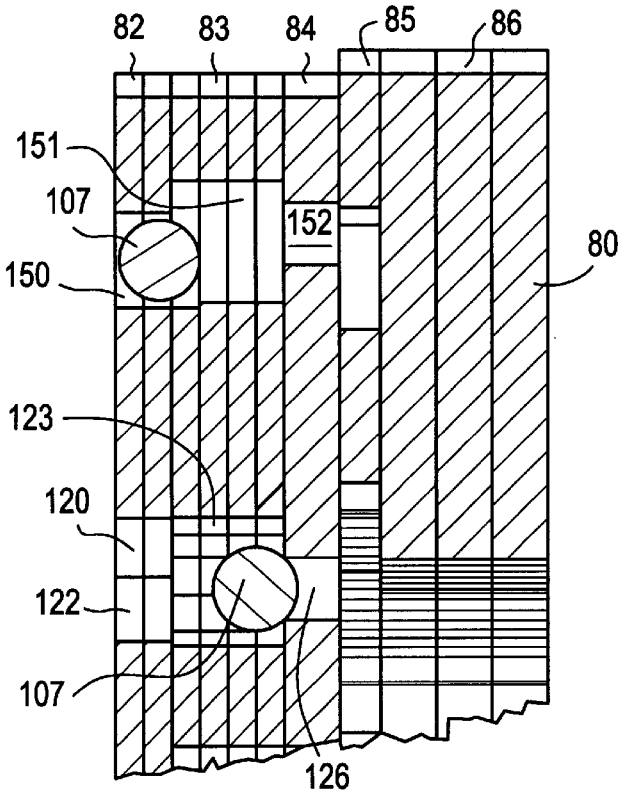
FIG. 11 is a cross-sectional side view of the rotating valve of FIG. 9 taken generally along lines 11—11 therein highlighting the seating of the ball check valves.

Two check balls 107, some 0.125" in diameter are located in the holes 151, 123 so as to provide for a check valve assembly. The diameter of the check balls are chosen such that the plates 82–86 of the valve 80 can be fully assembled and brazed together prior to the insertion of the check balls 107. This allows for the uncompromised assembly of the valve 80 in addition to allowing larger check balls relative to their respective holes (and thus also good closure on their respective seats). Note that the dimension of the passages in the valve must include consideration of any offset between passages—i.e. the check balls 107 should drop into their respective passages from the outside of an assembled valve to the extent of fully seating on their respective seats. Further the passages themselves are designed in cooperation with the check balls 107 so as to provide for a relatively unimpeded smooth laminar flow about the balls when the respective passage is functioning as a case drain. This is particularly important at the check balls 107 outermost position in plate 82 adjacent to the balancing ring 180. In the preferred embodiment two techniques are utilized (FIGS. 10 and 11). In respect to passage 150 (shown open in FIG. 11), the check ball 107 passes into hole 150 in plates 82. As these plates aggregate 0.084" in depth, the side edges of hole 151 in plate 83 localizes the ball 107 near the center of hole 150, thus allowing a flow of fluid past the ball 107 on either side thereof (the hole 150 is 0.330" in total length while the ball 107 has a maximum diameter of 0.125" leaving 0.205" for fluid passage, ignoring the circularity of the ball 107). In respect to passage 120 (shown closed in FIG. 11), the check ball 107 would pass into head 121 in plate 82 (the leg 122 is only 0.080" in width). This leaves the full extent of the leg 122 for fluid passage bypassing the ball 107 (the leg 122 is 0.185" in center to center length and 0.080" in width, again ignoring the circularity of the ball 107). As the upstream check holes 152, 126 in plate 84 are only 0.080" in diameter, the areas in hole 150 and leg 122 being greater in diameter are non-restrictive, thus reducing the fluidic forces on the balls 107 when in their respective open positions. Other methods of reducing the outward forces on the check ball 107 could also/instead be utilized. Examples include press in cages, stop plates, sidewards extending passages bypassing the balls and other techniques.

The check balls 107 in the valve 80 are relatively unrestrained in their respective passages. For this reason they are very fast actuating check valves, unseating quickly. This is especially so in contrast with spring loaded housing located check balls (such as that found in U.S. Pat. No. 3,572,983). Further the check valves are located directly between the cavity 25 and the port 111, 113 having lower relative pressure. This again provides a faster acting check valve than those devices containing complicated passages (such as U.S. Pat. No. 3,572,983, U.S. Pat. No. 4,390,329 and U.S. Pat. No. 4,480,972). The present check valves are much more efficient to manufacture and assemble, not needing the machining of the housing and numerous additional parts such as seals, springs, plugs, etc. used in the above art. The present check valves are also more efficient.

The later described balancing piston 180 retains the balls 107 in their respective holes.

Figure 9:
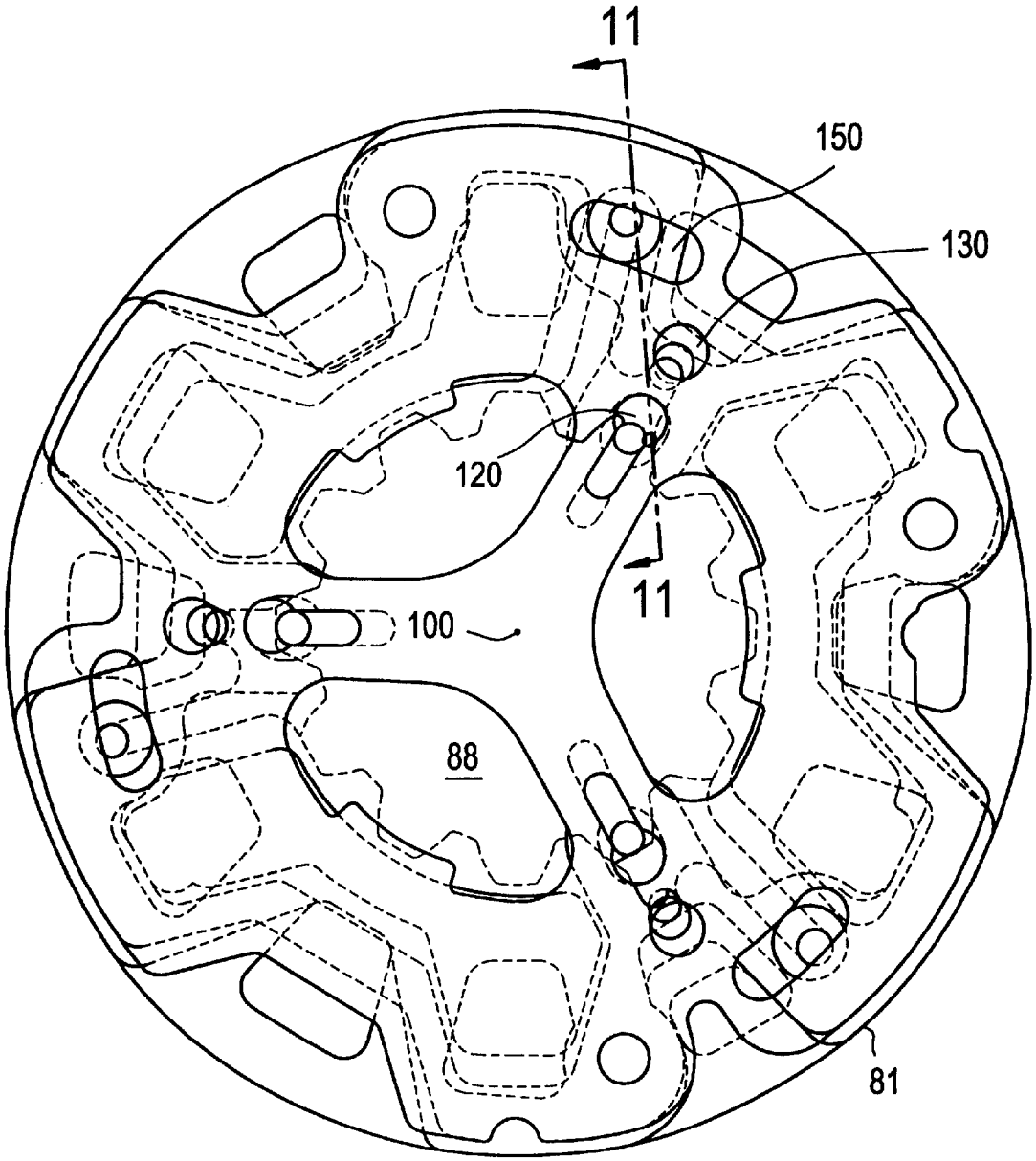
FIG. 9 is a see-through view of the valve taken substantially from lines 9—9 in FIG. 1.

The cooperation of the case drain passages in the valve is detailed in FIGS. 9, 10 and 11. When either passage 120, 150 is connected to a port 111, 113 respectively having a lower relative pressure than the center area 52 of the device, its respective ball 107 unseats from its seat 152, 126 so as to allow for the relatively unimpeded movement of fluid thereby. The other passage 120, 150, presumably connected to a higher pressure remains closed by its respective check ball 107, thus preventing the inadvertent cross-connection of ports 111, 113.

As is apparent from the above in addition to valving the gerotor structure 40, the valve 81 also serve as a pressure release/case drain mechanism. This is accomplished by the interconnection of the three holes 120, 130 and 150 in the communication plate 82 to the central area 52. This is accomplished by two passages 135, 155 in the preferred embodiment.

The first passage 155 extends radially outward of the valve, thus to interconnect the central area 52 to the hole 150 and thus the outside port 113 if such port has a lower relative pressure that such area 52.

The second passage 135 extends radially to the second and third holes 120, 130, thus connecting the central area 52 to the lands of the balancing piston 180 as well as the inside port 111 (again if the port has a lower relative pressure than the area 52). In any event the sizing of the valve seats and check valves for both passages is selected in combination with the rest of the device to control the volume of lubrication passing therethrough. This volume is about 0.2 to 0.5 gallon a minute in the preferred embodiment disclosed. The location of most restriction to fluid flow controls this volume. It is preferred that this restriction not be created by the check balls 107. In the embodiment disclosed, the passages 50 of the leakage path in the wear plate 27 control the volume of fluid.

The valving section 80 thus also includes a pressure release mechanism for the central area 52 of the gerotor pressure device. This pressure release mechanism includes the previously described two through holes 120, 150, each containing a ball check 107, in combination with their respective valve seats 126, 152. The balls 107 themselves cooperate with valve seats in order to interconnect the central area 52 to the inside port 111 or outside port 113 having the lowest relative pressure. This provides for a self-contained case drain for the cavity 25 of the hydraulic device, thus allowing the circulation of fluid therein as well as lowering the pressure thereof. By integrating these pressure release valves with the rotating valve, the overall complexity and cost of the gerotor pressure device is reduced.

The valve 81 is itself rotated by a valve stick 38 interconnected to the rotor 45 and thus through the wobblestick 36 to the drive shaft. This provides for the accurate timing and rotation of the valve 81.

Figure 16:
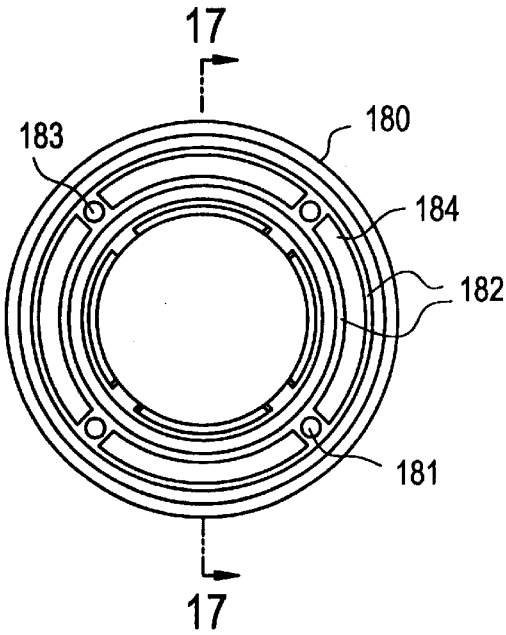
FIG. 16 is a surface view of the biasing piston of the device of FIG. 1 taken generally along lines 16—16 therein.
Figure 17:
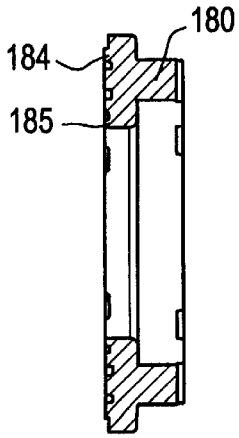
FIG. 17 is a cross-sectional view of the biasing piston of FIG. 16 taken generally along lines 17—17 therein.

A balancing ring 180 on the port plate 110 side of the valve 81 separates the inside port 111 from the outside port 113, thus allowing for the efficient operation of the device (FIGS. 16, 17). This balancing ring is substantially similar to that shown in the Eaton U.S. Pat. No. 3,572,983, Fluid Operated Motor. Four recessed areas 181 in the balancing ring 180 are aligned with the three unvalved holes 130 in the valve 80 so as to intermittently interconnect both the adjacent grooves 182 and the backside of the piston (via holes 183) to the central area of 52 of the device. This equalizes the pressure of these two areas through efficient intermittent pulses along the three unvalved holes 130 in the valve 80 (the pulses are intermittent due to the spacing differential between the holes 130 in the valve 80 (three in number) and the recessed areas 181 in the balancing ring 180 (four in number)). A series of springs located in pockets behind the balancing ring bias such piston against the valve 81 so as to reduce the chances of axial separation of the valve 81 from either the manifold 60 or the piston 120.

The radial and circumferential extensions of the holes 120, 150 in plates 82 and 83 reduce the check ball chattering against the later described balancing ring by allowing fluid to bypass the balls 107 when such are not seated on the valve plate 84. This increases the longevity of the balancing ring while also reducing any unusual noises from the hydraulic pressure device.

The particular balancing ring 180 has a 1.050" outer and 0.565" inner radius with a depth of 0.420". The outer land 184 has an outer radius of 0.980" and the inner land 185 has a 0.565" radius. Since the outer hole 150 in the adjoining valve 80 is spaced 1.014" and the inner hole 130 is spaced 0.615" from the center 100 of the valve and the check balls 107 have a diameter of 0.125", the balancing ring 180 serves to retain the check balls 107 in the holes 130 and 150. The reason for this is the lack of room for such balls to bypass such ring 180 (i.e. 1.079" minus 0.980" and 0.565" minus 0.55" are both less than 0.125"). This simplifies the device. The holes 183 in the balancing ring 180 are 0.100" in diameter centered on the inner land 184. The land itself is centered on a 0.817" radius from the center of the balancing ring. The particular balancing ring 180 has a hardened face adjacent to the valve 80 and its contained check balls 107. This hardening increases the service life of the device by reducing the speed of physical damage at this location.

The port plate 110 serves as the physical location for the valving section 80 in addition to providing a location for the pressure and return connections, typically a threaded opening (not shown). It thus completes the structure of the gerotor pressure device 10.

Although the invention has been described in its preferred form with a certain degree of particularity, it is to be understood that numerous changes can be made without deviating from the invention as hereinafter claimed. For example the valve is shown with three sets of three holes 120, 130, 150. This is primarily due to the design and sizing of the leakage path in the wear plate 27. This could be modified if desired, for example by eliminating the radial extension 56 or reducing the cross-section of the leakage paths one could use only one set of holes 120, 130, 150, producing a lower fluid flow. Similarly if the holes 72 and separate case drain 75 are included, the case drain holes 120, 150 might be omitted (in certain parameter designs). Alternate numbers and locations could thus be utilized without deviating from the invention herein.

What is claimed:

1. A hydraulic pressure device comprising a housing, a drive shaft, said drive shaft being rotatively connected to said housing, said drive shaft having an end, said end of said drive shaft extending from said housing, a fluid pressure device, said fluid pressure device being in said housing, said fluid pressure device having a movable member, means to drivingly connect said movable member to said drive shaft, said fluid pressure device having expanding and contracting pressure cells, said housing including a stationary manifold, said manifold having bi-directional manifold passages fluidically connected to said pressure cells of said fluid pressure device respectively, a rotating valve, said rotating valve having an outer circumferential surface, means to rotatively support said rotating valve to said housing for rotational movement in respect thereto by said outer circumferential surface of said rotating valve, said rotating valve including two sets of uni-directional valving passages, said rotating valve including a plurality of flat plates, said flat plates being formed with selective cross-sectional parts of said valving passages, said flat plates being consecutively sequentially located flat surface to flat surface, said flat plates being connected together in a leak proof manner to form said valving passages, said rotating valve having a commutation surface plate and a valving surface plate, said commutation surface plate being on the opposite axial side of said rotating valve from said valving surface plate, said commutation surface plate having a central opening, said central opening being fluidically connected to one of said two sets of uni-directional valving passages, said housing having an inlet port and an outlet port, central opening connect means at said commutation surface to fluidically connect said central opening to one of said inlet port or said outlet port, other connect means to fluidically connect the other of said two sets of uni-directional valving passages to the other of said inlet port or said outlet port, a balancing ring, said balancing ring being located within said housing adjacent to said commutation surface, said balancing ring extending between said housing and said commutation surface, said balancing ring having an open center, said open center of said balancing ring being in communication with said central opening of said commutation surface of said rotating valve, said means at said commutation surface to fluidically connect said central opening to one of said inlet or said outlet port including said open center of said balancing ring, said balancing ring fluidically sealing one of said inlet or said outlet port from the other of said inlet port or outlet port, means to drivingly connect said rotating valve to said drive shaft, and means at said valving surface of said rotating valve to selectively fluidically connect said two sets of uni-directional valving passages in said rotating valve to said bi-directional manifold passages in said stationary manifold.

2. The hydraulic pressure device of claim 1 characterized in that said flat plates of said rotating valve include valving passages extending in a radial and axial direction.

3. The hydraulic pressure device of claim 1 characterized in that there are uni-directional power generating fluid passages in the device, said uni-directional power generating fluid passages having a length, and substantially all of said length of said uni-directional power generating fluid passages are in said rotating valve.

4. The hydraulic pressure device of claim 3 characterized in that of said length of said uni-directional power generating fluid passages only said central opening connect means and said other connect means are not in said rotating valve.

5. The hydraulic pressure device of claim 4 characterized by said housing including a unitary port plate, and said unitary port plate containing said rotating valve, said central opening connect means and said other connect means.

6. The hydraulic pressure device of claim 5 characterized in that said unitary port plate contains said stationary manifold.

7. The hydraulic pressure device of claim 6 characterized in that said port plate has a cavity for said stationary manifold, said cavity having an axial length, said stationary manifold having an axial length, and said axial length of said stationary manifold being greater than said axial length of said cavity.

8. The hydraulic pressure device of claim 7 characterized in that said fluid pressure device has a stationary part and said stationary manifold is compressed with said port plate contacting said stationary part of said fluid pressure device.

9. The hydraulic pressure device of claim 1 characterized in that said unitary port plate contains said stationary manifold.

10. The hydraulic pressure device of claim 9 characterized in that said port plate has a cavity for said stationary manifold, said cavity having an axial length, said stationary manifold having an axial length, and said axial length of said stationary manifold being greater than said axial length of said cavity.

11. The hydraulic pressure device of claim 10 characterized in that said fluid pressure device has a stationary part and said stationary manifold is compressed with said port plate contacting said stationary part of said fluid pressure device.

12. The hydraulic pressure device of claim 1 characterized in that said flat plates include at least two sets of at least two adjoining plates having substantially the same lateral cross-section.

13. The hydraulic pressure device of claim 12 characterized in that said at least two sets includes said valving surface plates.

14. The hydraulic pressure device of claim 1 characterized said means to drivingly connect said rotating valve to said drive shaft includes an opening in said valving surface plate.

15. The hydraulic pressure device of claim 14 characterized in that said at least two sets includes said valving surface plates.

16. The hydraulic pressure device of claim 1 characterized in that said other connect means includes an axial passage in said flat plates of said rotating valve.

17. The hydraulic pressure device of claim 1 characterized in that said other connect means includes an radial passage in said flat plates of said rotating valve.

18. The hydraulic pressure device of claim 14 characterized by said balancing ring including a surface adjoining said commutation plate and said rotating valve includes a relief passage extending from said surface of said balancing ring to said opening in said valving surface plate.

19. The hydraulic pressure device of claim 1 characterized in that said outer circumferential outer surface of said rotary valve has an axial length and substantially all of said axial length being rotatively supported to said housing.

20. The hydraulic pressure device of claim 1 characterized in that said outer circumferential outer surface of said rotary valve has an axial length and not all of substantially said axial length being rotatively supported to said housing.

21. The hydraulic pressure device of claim 1 characterized by said balancing ring including a surface adjoining said commutation plate and said rotating valve includes a relief passage extending from said surface of said balancing ring to an opening in said valving surface plate.

22. The hydraulic pressure device of claim 1 characterized by said stationary manifold having an outside circumference, said outer circumference having an area, means to connect said area to one of the two fluid ports, a passage, and said passage connecting said area to the central area of the device.

23. The hydraulic pressure device of claim 1 characterized by the addition of valving openings the valve, said stationary manifold having valving passages and an area surrounding its outer circumference, the rotating valve selectively connecting said valving openings in the rotating valve to said valving passages in said stationary manifold, and means in said manifold to connect said area to the central area of the device so as to interconnect said area to the central area drain.

24. The hydraulic pressure device of claim 23 characterized in that said means to connect the central area to said case drain includes a passage in the rotating valve.

25. The hydraulic pressure device of claim 23 characterized in that said means to connect the central area to said case drain includes a passage in the housing of the device.

* * * * *